US012584493B2

(12) United States Patent
Wei et al.

(10) Patent No.: US 12,584,493 B2
(45) Date of Patent: Mar. 24, 2026

(54) FAN BLADE AND AIR SUPPLY DEVICE

(71) Applicant: GD Midea Environment Appliances MFG Co., Ltd., Zhongshan (CN)

(72) Inventors: Lai Wei, Zhongshan (CN); Ruixiang Kang, Zhongshan (CN); Dan Luo, Zhongshan (CN); Wenkang Pan, Zhongshan (CN); Sijin Ye, Zhongshan (CN)

(73) Assignee: GD MIDEA ENVIRONMENT APPLIANCES MFG CO., LTD., Zhongshan (CN)

( * ) Notice: Subject to any disclaimer, the term of this patent is extended or adjusted under 35 U.S.C. 154(b) by 0 days.

(21) Appl. No.: 18/966,670

(22) Filed: Dec. 3, 2024

(65) Prior Publication Data

US 2025/0215890 A1 Jul. 3, 2025

(30) Foreign Application Priority Data

Dec. 29, 2023 (CN) ..... 202311856952.9

(51) Int. Cl.
*F04D 29/38* (2006.01)
*F04D 19/00* (2006.01)
*F04D 29/32* (2006.01)

(52) U.S. Cl.
CPC ..... *F04D 29/388* (2013.01); *F04D 19/002* (2013.01); *F04D 29/325* (2013.01); *F04D 29/384* (2013.01)

(58) Field of Classification Search
CPC ..... F04D 29/384; F05D 2240/307
See application file for complete search history.

(56) References Cited

U.S. PATENT DOCUMENTS 6,736,600 B1 5/2004 Bannasch
9,926,058 B2 3/2018 Sharrow
(Continued)

FOREIGN PATENT DOCUMENTS

CN 114321010 A 4/2022
CN 116950925 A 10/2023
(Continued)

OTHER PUBLICATIONS

GD Midea Environment Appliances MFG Co., Ltd., Extended European Search Report, EP Patent Application No. 24203663.0, Mar. 6, 2025, 7 pgs.
(Continued)

*Primary Examiner* — Courtney D Heinle
*Assistant Examiner* — John S Hunter, Jr.
(74) *Attorney, Agent, or Firm* — Morgan, Lewis & Bockius LLP

(57) ABSTRACT

A fan blade includes a hub and a blade connected to a circumferential side face of the hub. The blade presents a circular shape, the inner annular surface of the blade encloses a hollow area. In the radial direction of the hub, an end of the blade connected to the hub is the root part of the blade. In a direction from the end part to the root part, at least a portion of the area of the blade is a first segment part that includes a first inner annular surface and a first outer annular surface. In the axial direction of the hub, the first inner annular surface and the first outer annular surface turn direction at the end part, and the first inner annular surface and the first outer annular surface on both sides of the end part do not overlap.

20 Claims, 11 Drawing Sheets

(56) References Cited

U.S. PATENT DOCUMENTS

| | | | |
|---|---|---|---|
| D974,268 | S | 1/2023 | Sharrow |
| 2004/0067138 | A1 | 4/2004 | Yoshida |

FOREIGN PATENT DOCUMENTS

| | | | | |
|---|---|---|---|---|
| CN | 220505354 | U | 2/2024 | |
| CN | 220505356 | U | 2/2024 | |
| JP | 2016507410 | A | 3/2016 | |
| JP | 2019517408 | A | 6/2019 | |
| KR | 20120003566 | U | 5/2012 | |
| WO | WO 2002059464 | A1 | 8/2002 | |
| WO | WO 2019155656 | A1 | 8/2019 | |
| WO | WO 2023108817 | A1 | 6/2023 | |
| WO | WO-2025106675 | A1 * | 5/2025 | ..... B63H 1/28 |

OTHER PUBLICATIONS

GD Midea Environment Appliances MFG Co., Ltd., Chinese Office Action, CN Patent Application No. 202311856952.9, Mar. 19, 2025, 16 pgs.

GD Midea Environment Appliances MFG Co., Ltd., Japanese Office Action, JP Patent Application No. 2024-091992, Jun. 27, 2025, 6 pgs.

GD Midea Environment Appliances MFG Co., Ltd., Korean Office Action, KR Patent Application No. 10-2024-0073853, Oct. 25, 2025, 10 pgs.

* cited by examiner

FAN BLADE AND AIR SUPPLY DEVICE

CROSS-REFERENCE TO RELATED APPLICATIONS

The present application claims priority to Chinese Patent Application No. 202311856952.9 filed with China National Intellectual Property Administration on Dec. 29, 2023, and entitled "FAN BLADE AND AIR SUPPLY DEVICE", which is incorporated herein by reference in its entirety.

FIELD

The present disclosure relates to the technical field of air supply devices, and specifically, relates to a fan blade and an air supply device.

BACKGROUND

In the related art, some fan blades use a circular blade solution to lower noise.

But the structure of the tip of the circular blade is relatively complex, and cannot be produced with a mold, or the mold has a complex structure and a high cost, and the produced blade will have a structure such as a burr which affects product performance. This results in the technical defects of high process complexity, high process cost and poor product performance of the blade.

Therefore, how to overcome the above technical defects has become a technical problem that needs to be solved urgently.

SUMMARY

The present disclosure aims to solve at least one of the technical problems in the prior art.

In view of this, the first aspect of the present disclosure provides a fan blade.

The second aspect of the present disclosure provides an air supply device.

In view of this, the first aspect of the present disclosure provides a fan blade, and the fan blade comprises: a hub; a blade connected to the circumferential side face of the hub, and the blade presents a circular shape, the inner annular surface of the blade encloses a hollow area, or the inner annular surface of the blade and the circumferential side face of the hub enclose a hollow area; in a radial direction of the hub, an end of the blade connected to the hub is the root part of the blade, and an end thereof away from the hub is the end part of the blade; and in a direction from the end part to the root part, at least a portion of the area of the blade is a first segment part, and the first segment part comprises a first inner annular surface and a first outer annular surface; in an axial direction of the hub, the first inner annular surface and the first outer annular surface turn direction at the end part, and the first inner annular surface and the first outer annular surface on both sides of the end part do not overlap.

In some embodiments, a fan blade is provided, the fan blade can be used in an air supply device, and the rotating of the fan blade can blow out an airflow flowing directionally, to supply air to a designated area.

The fan blade comprises the hub and the blade, the hub is a rotation center on the fan blade, the blade is mounted at the circumferential side of the hub, during operation, the hub brings the blade to rotate in the axis of the hub, to blow out the airflow flowing directionally through the synchronous rotation of the blade.

The blade presents a circular shape, and in some embodiments the blade can be a closed circular blade, and is connected to the hub at the outer side, and can also be a circular blade comprising an opening and is connected to the hub through the opening. The blade comprises an inner annular surface and an outer annular surface, in the case that the blade itself is closed, the inner annular surface of the blade encloses the hollow area, and there is an included angle between the axis of the hollow area and the axis of the hub. In the case that the blade comprises the opening, the inner annular surface of the blade cooperates with the circumferential side face of the hub to jointly enclose the hollow area, and there is also an included angle between the hollow area and the axis of the hub.

In some embodiments, the area of the circular blade connected to the hub is the root part of the blade, and the end in the radial direction of hub and away from the hub is the end part of the blade.

During the high speed rotation of the blade, noise can be lowered through the enclosed hollow area, to lower the noise generated during the high speed rotation of the fan blade, and then the noise lowering design of the fan blade is achieved, and users' use experience is improved.

In some embodiments, producing the circular blade through a casting molding process can improve production efficiency and lower production cost, however, the end part of the circular blade has high structure complexity, and the end part of the circular blade needs to be molded through multiple molds of different demolding directions during production, and this renders the increase of the complexity and the cost of the molds, and complex end parts cannot be molded through molds in extreme situations. Meanwhile, during molding the end part of the blade jointly through multiple molds, there is an inevitable gap between two adjacent molds, and this gap will form a burr on the end part of the blade, the burr will destruct the aerodynamic property of the blade, and then damage the aerodynamic performance of the blade and increase an aerodynamic noise.

Therefore, on the blade provided in the present disclosure, at least a portion of the area from the end part of the blade to the root part of the blade is the first segment part, that is, the first segment part certainly cover the end part of the blade, and the first segment part can be the tip end of the blade, the latter half segment of the blade, or the whole segment of the blade.

And the first segment part comprises the first inner annular surface and the first outer annular surface, when the fan blade is observed in the axial direction of the hub, the first inner annular surface and the first outer annular surface turn directions at the end part through torsion, that is, the end part is a boundary area in the first segment part. For example, the first inner annular surface that can be observed originally turns to a back orientation through the torsion of the end part, and the first outer annular surface that cannot be observed originally turns to a front orientation that can be observed through the torsion of the end part, or, the first outer annular surface that can be observed originally turns to a back orientation through the torsion of the end part, and the first inner annular surface that cannot be observed originally turns to a front orientation that can be observed through the torsion of the end part.

Based on the above, the first outer annular surface and the first inner annular surface at the two sides of the end part do not overlap, for example, the first segment part exposes the first outer annular surface before turning direction, and the first inner annular surface will not shield the first outer annular surface after the turning, and likewise, the first outer annular surface before the turning will not shield the first inner annular surface after the turning, vice versa.

Through arranging the first segment part that does not overlap, the first segment part can be molded by two molds, the demolding directions of the two molds correspond to the two directions of the axis of the hub, i.e., one mold demolds from the front face to mold the first inner annular surface and the first outer annular surface which can be observed from the front face; the other mold demolds from the back face to mold the first inner annular surface and the first outer annular surface which cannot be observed, to reduce the number of the molds for molding the first segment part; the end part corresponds to the parting line between two molds, i.e., the structure of the first side of the end part is molded through one of the molds, and the structure of the other side is molded through the other mold.

Thus it can be seen that the blade provided in the present disclosure can reduce the number of the molds through optimizing the structure of the tip end, and reduce the complexity of the molds and the cost of the molds, and the blade is applicable to an integrated molding process using molds, and meanwhile, reducing the number of the molds can reduce the probability of the burr occurring on the blade, and thus improve the aerodynamic performance of the blade, and reduce the aerodynamic noise of the blade, to solve the technical defects existing in the related art.

Furthermore, the technical effects of optimizing the structure of the blade, lowering the process complexity of the blade, lowering the product cost of the blade and improving product performance of the blade are achieved.

In some embodiments, the front face of the fan blade corresponds to the front face of the hub, the back face of the fan blade corresponds to the back face of the hub, the back face of the hub comprises a blind hole for the inserted connection to a rotating shaft, and the rotating shaft is inserted into the fan blade through the back face of the fan blade.

In addition, the above fan blade provided by the present disclosure can also comprise following additional technical features.

In some embodiments of the present disclosure, in the radial direction of the hub, the distance between the end part and the axis of the hub is the outer diameter d0 of the fan blade; in the radial direction of the hub, the length of the first segment part is d1; d0 and d1 satisfy the following relation:

$$0.01 \times d0 \leqslant d1 \leqslant 0.2 \times d0.$$

In some embodiments, the area of the first segment part is defined. In the radial direction of the hub, the distance between the end part and the axis of the hub is the outer diameter d0 of the fan blade, and the outer diameter d0 is the sum of the radius of the hub and the length of the blade.

Correspondingly, in the radial direction of the hub, the length of the first segment part is d1, that is, a distance that the end part extends towards the root part, the larger d1 is, the higher the coverage proportion of the first segment part is; the smaller d1 is, the lower the coverage proportion of the first segment part is.

On this basis, d0 and d1 satisfy the relation: $0.01\times d0 \leq d1 \leq 0.2\times d0$.

Through defining the above size relation, firstly, it can be ensured that the length of the first segment part can meet the need of lowering the noise of the blade, and the noise lowering performance of the blade is ensured, and secondly, it can be prevented that an excessively long first segment part affects other intrinsic properties of the blade, then the applicable range of the blade is widened, and the blade can consider a plurality of aerodynamic advantages.

Meanwhile, through defining $d1 \leq 0.2\times d0$, it can provide convenience for the miniaturized design and the lightweight design of the fan blade.

In some embodiments of the present disclosure, the blade further comprises a second segment part, and the second segment part comprises a second inner annular surface and a second outer annular surface; the blade further comprises a third segment part, and the third segment part comprises a third inner annular surface and a third outer annular surface; the first segment part is connected to the second segment part and the third segment part; and in the axial direction of the hub, the second inner annular surface and the first inner annular surface are not shielded and the third outer annular surface and the first outer annular surface are not shielded, or, the third inner annular surface and the first inner annular surface are not shielded and the second outer annular surface and the first outer annular surface are not shielded.

In some embodiments, the blade further comprises the second segment part and the third segment part, the second segment part and the third segment part are respectively connected to the two sides of the first segment part, that is, the first segment part is in a transitional connection to the second segment part and the third segment part, and meanwhile, the second segment part and the third segment part are symmetric about the parting line on the first segment part.

On this basis, the second segment part comprises the second inner annular surface and the second outer annular surface, and the third segment part comprises the third inner annular surface and the third outer annular surface. When the fan blade is observed through the axial direction of the hub, the face on the first segment part connected to the second segment part is the first outer annular surface, then the second outer annular surface on the second segment part and the first outer annular surface are simultaneously exposed, the second outer annular surface is not shielded, and correspondingly, the third inner annular surface on the third segment part and the first inner annular surface at the other side of the end part are simultaneously exposed, and the third inner annular surface is not shielded, vice versa.

Through defining the above second segment part and the third segment part, two air guiding segments can be formed on the basis of the first segment part, the two air guiding segments are used for guiding the flow direction of an airflow, firstly, this ensures that an air supply direction and an air supply strength meet needs, and secondly, this can cooperate with the first segment part to lower the aerodynamic noise of the fan blade. Meanwhile, through defining the above simultaneous exposure relation, two molds can be used to mold the first segment part, the second segment part and the third segment part at the same time, to lower the process complexity of the fan blade, reduce the cost of the molds, and then improve the market competitiveness of the fan blade.

In some embodiments of the present disclosure, in the radial direction of the hub, the distance between the end part and the axis of the hub is the outer diameter d0 of the fan blade; in the radial direction of the hub, the length of the second segment part is d2; d0 and d2 satisfy the following relation:

$$0 < d2 < 0.1 \times d0.$$

In some embodiments, the area of the second segment part is defined. In the radial direction of the hub, the distance between the end part and the axis of the hub is the outer diameter d0 of the fan blade, and the outer diameter d0 is the sum of the radius of the hub and the length of the blade.

Correspondingly, in the radial direction of the hub, the length of the second segment part is d2, that is, a distance that the end part extends towards the root part, the larger d2 is, the higher the coverage proportion of the second segment part is; the smaller d2 is, the lower the coverage proportion of the second segment part is.

On this basis, d0 and d2 satisfy the relation: $0<d2<0.1\times d0$.

Through defining the above size relation, on the basis of meeting an airflow guiding need through the second segment part and the third segment part, it can prevent affecting other intrinsic properties of the blade due to an excessively long second segment part, then the applicable range of the blade is widened, and the blade can consider a plurality of aerodynamic advantages.

Meanwhile, through defining $d2<0.1\times d0$, it can provide convenience for the miniaturized design and the lightweight design of the fan blade.

In some embodiments of the present disclosure, the fan blade is configured to rotate in a first rotating direction; in the first rotating direction, the third outer annular surface is located at the front side of the second inner annular surface.

In some embodiments, the calibrated rotating direction of the fan blade is the first rotating direction, and the rotating direction during actual use may be the same with the calibrated rotating direction and may also be opposite to the calibrated rotating direction.

On this basis, in the first rotating direction, the third outer annular surface is located at the front side of the second inner annular surface, correspondingly, the third inner annular surface is located at the front side of the second outer annular surface, when the fan blade rotates in the first rotating direction, the third outer annular surface and the second inner annular surface are windward sides, and the second outer annular surface and the third inner annular surface are leeward sides. Moreover, in the axial direction of the hub, the second segment part and the third segment part are in a staggered arrangement, the third segment part is close to the front face of the hub, and the second segment part is close to the back face of the hub.

Through defining the above relation between the position of the second segment part and the calibrated rotating direction and the relation between the position of the third segment part and the calibrated rotating direction, the noise lowering performance of the blade can be optimized, the noise lowering effect of the blade during high speed rotation can be optimized, and thus users' use experience is improved.

In some embodiments of the present disclosure, at least a portion of the first inner annular surface close to the end part extends in the axial direction of the hub; and/or at least a portion of the first outer annular surface close to the end part extends in the axial direction of the hub.

In some embodiments, at least a portion of the first inner annular surface close to the end part can extend in the axial direction of the hub, when the fan blade is observed from the axial direction of the hub, the points in at least a portion of the first inner annular surface overlap to form a line, that is, at least a portion of the area of the first inner annular surface is shielded by itself.

Correspondingly, at least a portion of the first outer annular surface close to the end part can also extend in the axial direction of the hub, when the fan blade is observed from the axial direction of the hub, the points in at least a portion of the first outer annular surface overlap to form a line, that is, at least a portion of the area of the first outer annular surface is shielded by itself.

Through defining the above features, the sharpness and the torsion amplitude of the end part of the blade can be reduced on the basis that the number of molds and the structure complexity of the molds are not increased, and then the aerodynamic performance of the blade is optimized, and the blade can meet the air supply need and the noise lowering need of the fan blade.

In some embodiments of the present disclosure, in the circumferential direction of the hub, the size of the hollow area is L2; and $L2>5$ mm.

In some embodiments, in the circumferential direction of the hub, the size of the hollow area enclosed by the inner annular surface of the blade is L2, when the fan blade is observed from the axial direction of the hub, L2 is the length of an arc segment in the hollow area which axis is the axis of the hub, and the size of L2 affects the width of the hollow area.

On this basis, L2 needs to be greater than 5 mm; through defining the above size range, it can be ensured that there is a sufficiently wide hollow area at the inner side of the blade, to ensure the noise lowering performance during the high speed rotation of the blade, and then the technical effects of lowering the aerodynamic noise of the fan blade and improving users' use experience are achieved.

In some embodiments of the present disclosure, in the circumferential direction of the hub, the size of the first segment part is L1; L1 decreases gradually in the direction from the root part to the end part.

In some embodiments, in the circumferential direction of the hub, the size of the first segment part is L1, when the fan blade is observed from the axial direction of the hub, L1 is the length of an arc segment connecting the outer contour lines on both sides of the first segment part, and the arc segment takes the axis of the hub as its axis, and the size of L1 affects the width of the first segment part.

On this basis, in the direction from the root part of the blade to the end part of the blade, L1 decreases gradually, that is, the width of the first segment part tapers in the direction away from the hub, and the first segment part present a sharp shape. Through defining the shape of the above first segment part, the noise lowering performance can be ensured during the high speed rotation of the blade, and then the technical effects of lowering the aerodynamic noise of the fan blade and improving users' use experience are achieved.

In some embodiments of the present disclosure, a cross-section of the blade obtained by a curved plane centered about an axis of the hub transversely intersecting the blade has an outer contour which comprises a first smooth convex curve and a second smooth concave curve.

In some embodiments, the shape of the blade is defined. Any area of the blade is sectioned through the curved surface taking the axis of the hub as its axis, to obtain the cross-section of the blade. And the outer contour of the cross-section of the blade comprises the first smooth curve protruding outwards (i.e. the first smooth convex curve) and the second smooth curve concaved inwards (i.e. the second smooth concave curve), and the first smooth curve and the second smooth curve are snapped to form the outer contour of the cross-section of the blade.

Through defining the shape of the above cross-section, the blade keeps a torsion trend throughout the whole segment; it is taken as an example that the two ends of the blade are both connected to the circumferential side face of the hub, and the first end of the blade first exposes the outer annular surface, in the direction from the first end of the blade to the end part, the blade changes the exposed area of the outer annular surface through torsion, until the torsion continues to the end part and then the turning of the inner and outer annular surfaces is completed, then the inner annular surface starts to be exposed; in the direction from the end part to the second end of the blade, the exposed area of the inner annular surface also changes in with the torsion trend, vice versa, that is, a strip-shaped blade maintains torsion during surrounding.

Through defining the shape of the cross-section of the above blade, the point of sudden change of shape on the blade can be prevented, therefore, firstly, the noise lowering performance during the high speed rotation of the blade is ensured, then the technical effects of lowering the aerodynamic noise of the fan blade and improving users' use experience are achieved, and secondly, the resistance of the blade is lowered, and the energy efficiency ratio of an air supply device is improved.

In some embodiments of the present disclosure, the fan blade is configured to rotate in the first rotating direction; in the first rotating direction, the second smooth curve is located at the front side of the first smooth curve.

In some embodiments, the calibrated rotating direction of the fan blade is the first rotating direction, and the rotating direction during actual use may be the same with the calibrated rotating direction and may also be opposite to the calibrated rotating direction.

On this basis, in the first rotating direction, the second smooth curve is located at the front side of the first smooth curve, in the process that the fan blade rotates in the first rotating direction as calibrated, the first smooth curve corresponds to a pressure side of the blade, and the second smooth curve corresponds to a sucking side of the blade.

Through defining the relation between the shape of the blade and the rotating direction, the noise lowering performance of the blade can be optimized, the noise lowering effect during the high speed rotation of the blade can be optimized, and thus users' use experience is improved.

In some embodiments of the present disclosure, the number of blades is plural; and the plurality of blades are uniformly distributed around the hub.

In some embodiments, the number of blades is plural, and the plurality of blades are uniformly distributed around the axis of the hub, that is, the included angle between any two adjacent blades among the plurality of blades is the same.

In some embodiments, the number of the blades is greater than or equal to 3.

Through arranging the plurality of uniformly distributed blades, the air supply strength and the air supply uniformity of the fan blade can be improved without changing the rotation speed of the fan blade, thus the aerodynamic performance of the fan blade is optimized, and the practicability and reliability of the fan blade is improved.

The second aspect of the present disclosure provides an air supply device, and the air supply device comprises: the fan blade in any of the above embodiments; a driving part connected to the hub, and the driving part is used for driving the fan blade to rotate.

In some embodiments, the air supply device comprising the fan blade in any of the above embodiments is defined, and the air supply device comprises a pedestal fan, a cooling fan, an exhaust fan, etc. Therefore, the air supply device comprises the advantages of the fan blade in any of the above embodiments, and can achieve the technical effects that the fan blade in any of the above embodiments can achieve, which are not repeated herein to avoid repetition.

On this basis, the air supply device further comprises the driving part, the driving part is connected to the hub on the fan blade, and after electrified, the driving part is used to bring the hub and the blades to rotate synchronously.

In one embodiment, the driving part comprises a motor, and a rotating shaft of the motor is inserted into the hub to bring the hub and the blades to rotate.

The additional aspects and advantages of the present disclosure will be obvious in the following description, or can be understood through the implementation of the present disclosure.

BRIEF DESCRIPTION OF THE DRAWINGS

The above and/or additional aspects and advantages of the present disclosure will be obvious and understood easily from the following description of some embodiments in combination with the accompanying drawings.

And the corresponding relationships between the reference signs and the component names in FIG. 1 to FIG. 20 are as follows:

100 fan blade, 110 hub, 120 blade, 1202 root part, 1204 end part, 1206 hollow area, 1208 inner annular surface, 1209 outer annular surface, 122 first segment part, 1222 first inner annular surface, 1224 first outer annular surface, 124 second segment part, 1242 second inner annular surface, 1244 second outer annular surface, 126 third segment part, 1262 third inner annular surface, 1264 third outer annular surface, 128 cross-section, 1282 first smooth curve, 1284 second smooth curve, 129 second blade, 130 air guiding ring, 200 air supply device, 210 driving part.

DETAILED DESCRIPTION OF THE DISCLOSURE

To more clearly understand the above purposes, features and advantages of the present disclosure, the present disclosure will be further detailed hereinafter in combination with the accompanying drawings and embodiments. It should be indicated that in the case of no conflict, the embodiments and the features in the embodiments of the present disclosure can be combined with each other.

Many details are illustrated in the following description for the convenience of a thorough understanding to the present disclosure, but the present disclosure can also be implemented using other embodiments other than these described herein. Therefore, the protection scope of the present disclosure is not limited to the embodiments disclosed in the following text.

A fan blade and an air supply device according to some embodiments of the present disclosure are described in the following by referring to FIG. 1 to FIG. 20.

As shown in FIG. 1, FIG. 2, FIG. 3, FIG. 7 and FIG. 8, an embodiment of the present disclosure provides a fan blade 100, and the fan blade 100 comprises: a hub 110; a blade 120 connected to the circumferential side face of the hub 110, and the blade 120 presents a circular shape, the inner annular surface 1208 of the blade 120 encloses a hollow area 1206, or the inner annular surface 1208 of the blade 120 and the circumferential side face of the hub 110 enclose a hollow area 1206; in the radial direction of the hub 110, an end of the blade 120 connected to the hub 110 is the root part 1202 of the blade 120, and an end thereof away from the hub 110 is the end part 1204 of the blade 120; and in a direction from the end part 1204 to the root part 1202, at least a portion of the area of the blade 120 is a first segment part 122, and the first segment part 122 comprises a first inner annular surface 1222 and a first outer annular surface 1224; in the axial direction of the hub 110, the first inner annular surface 1222 and the first outer annular surface 1224 turn direction at the end part 1204, and the first inner annular surface 1222 and the first outer annular surface 1224 on both sides of the end part 1204 do not overlap.

Figure 1:
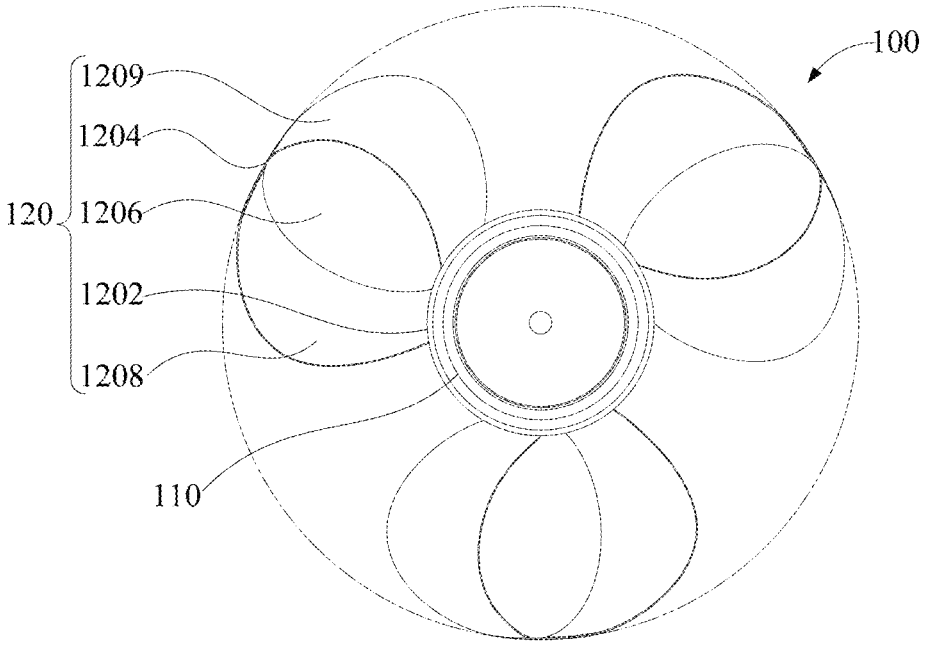
FIG. 1 is a front view of a fan blade according to an embodiment of the present disclosure.

FIG. 1 is a front view of a fan blade 100 according to an embodiment of the present disclosure.

Figure 2:
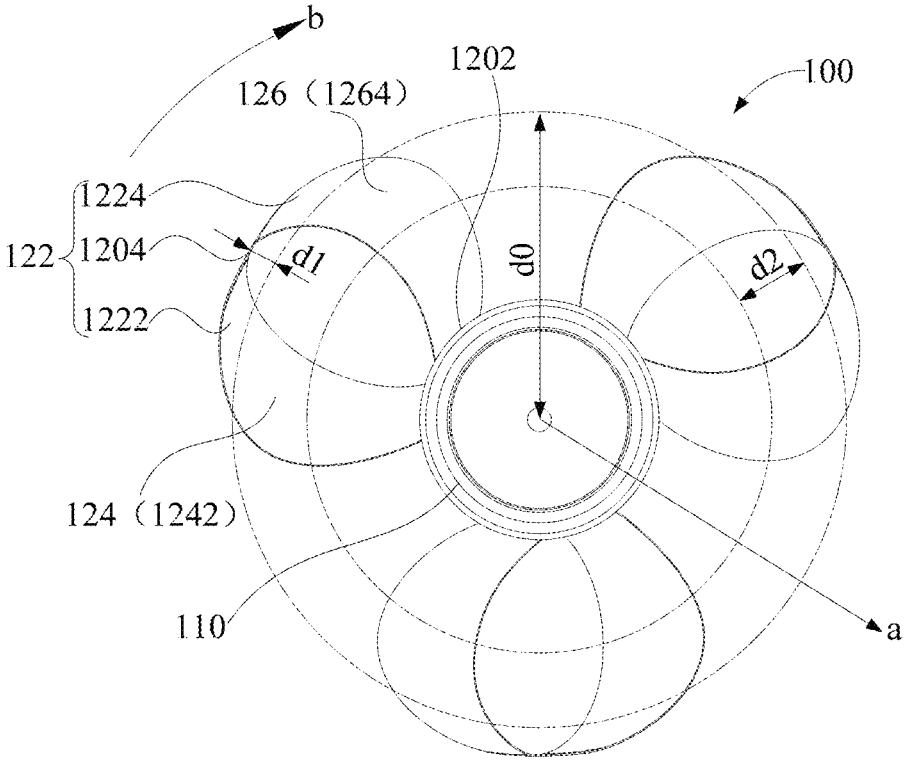
FIG. 2 is a front view of a fan blade according to an embodiment of the present disclosure.

FIG. 2 is a front view of a fan blade 100 according to an embodiment of the present disclosure, the arrow a in FIG. 2 shows the radial direction of the hub 110, and the arrow b shows the first rotating direction of the fan blade 100.

Figure 3:
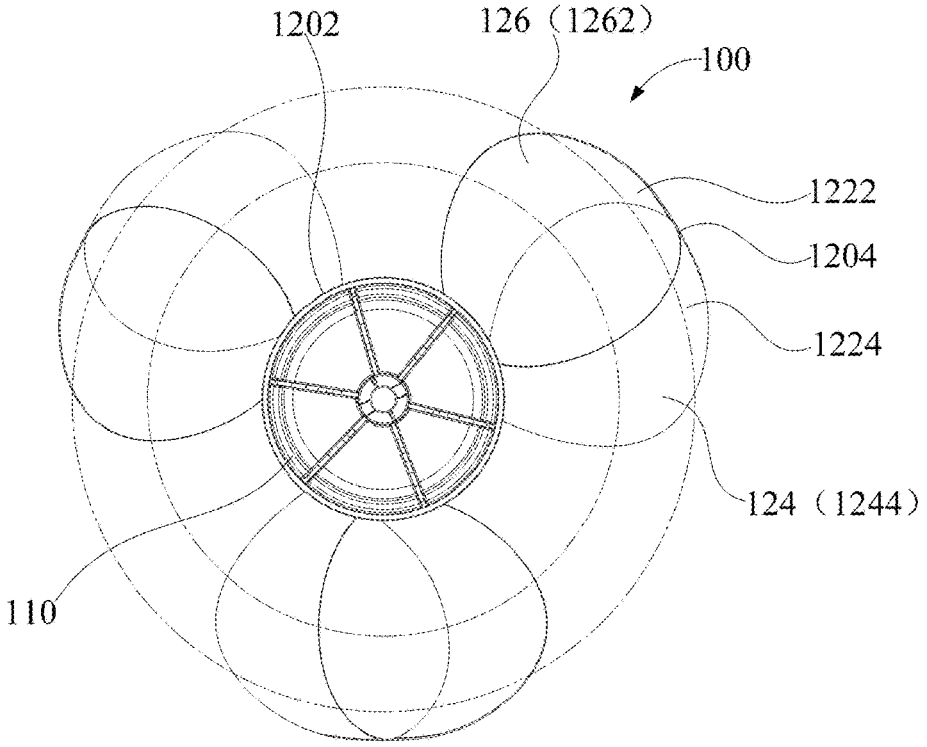
FIG. 3 is a rear view of a fan blade according to an embodiment of the present disclosure.

FIG. 3 is a rear view of a fan blade 100 according to an embodiment of the present disclosure.

Figure 7:
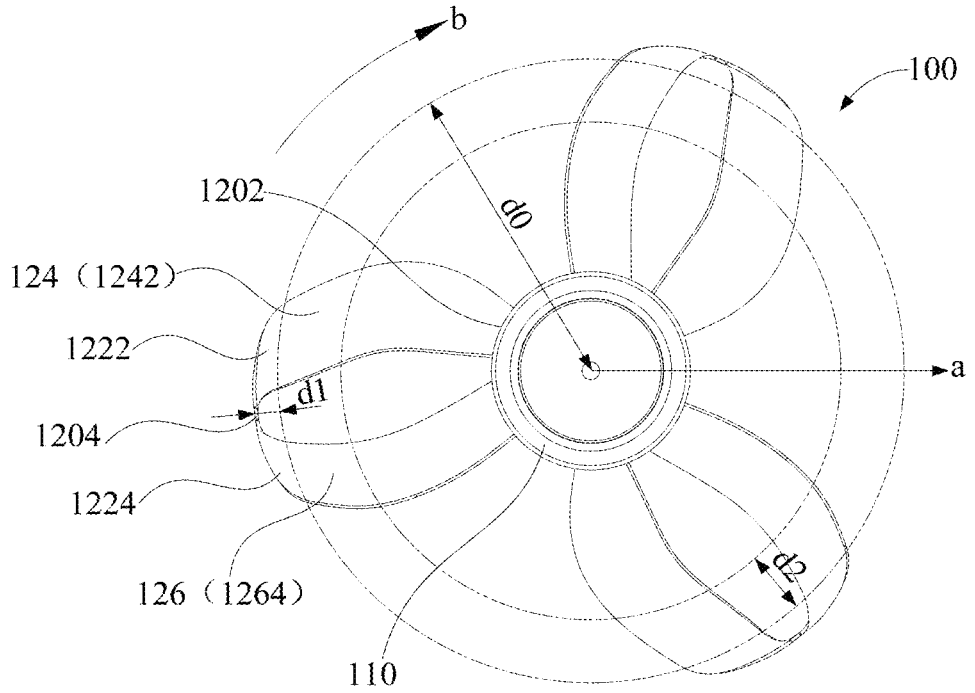
FIG. 7 is a front view of a fan blade according to an embodiment of the present disclosure.

FIG. 7 is a front view of a fan blade 100 according to an embodiment of the present disclosure, and the arrow a in FIG. 7 shows the radial direction of the hub 110, and the arrow b shows the first rotating direction of the fan blade 100.

Figure 8:
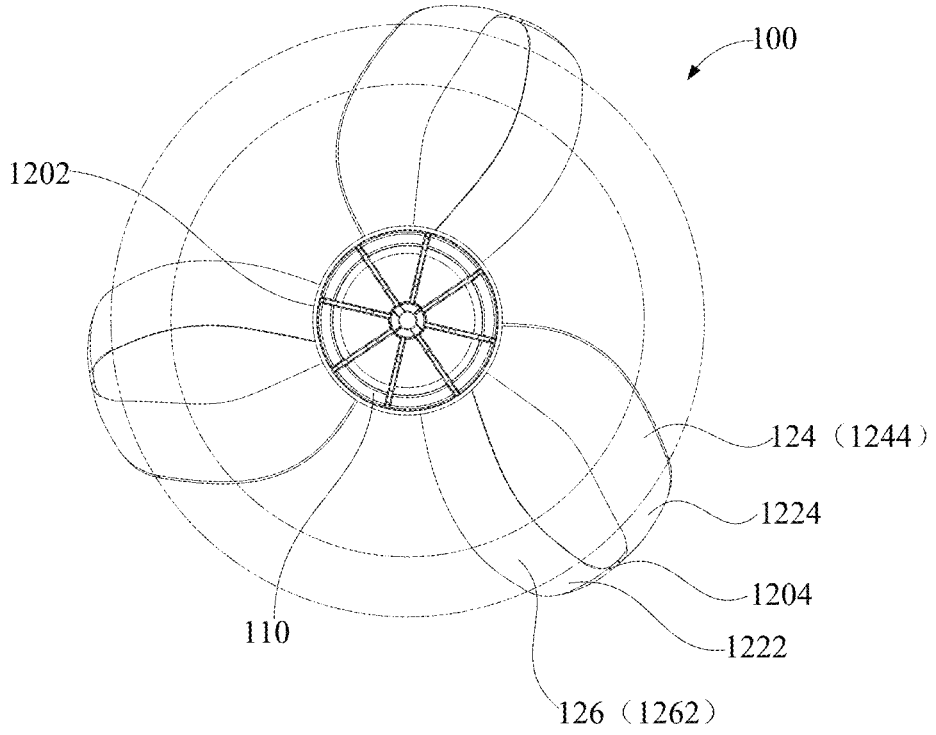
FIG. 8 is a rear view of a fan blade according to an embodiment of the present disclosure.

FIG. 8 is a rear view of a fan blade 100 according to an embodiment of the present disclosure.

In some embodiments, a fan blade 100 is provided, the fan blade 100 can be used in an air supply device 200, and the rotating of the fan blade 100 can blow out an airflow flowing directionally, to supply air to a designated area.

The fan blade 100 comprises the hub 110 and the blade 120, the hub 110 is a rotation center on the fan blade 100, the blade 120 is mounted at the circumferential side of the hub 110, during operation, the hub 110 brings the blade 120 to rotate about the axis of the hub 110, to blow out the airflow flowing directionally through the synchronous rotation of the blade 120.

And the blade 120 presents a circular shape and in some embodiments the blade can be a closed circular blade 120, and is connected to the hub 110 at the outer side, and can also be a circular blade 120 comprising an opening and is connected to the hub 110 through the opening. The blade 120 comprises an inner annular surface 1208 and an outer annular surface 1209, in the case that the blade 120 itself is closed, the inner annular surface 1208 of the blade 120 encloses the hollow area 1206, and there is an included angle between the axis of the hollow area 1206 and the axis of the hub 110. In the case that the blade 120 comprises the opening, the inner annular surface 1208 of the blade 120 cooperates with the circumferential side face of the hub 110 to jointly enclose the hollow area 1206, and there is also an included angle between the hollow area 1206 and the axis of the hub 110.

In some embodiments, the area of the circular blade 120 connected to the hub 110 is the root part 1202 of the blade 120, and the end in the radial direction of hub 110 and away from the hub 110 is the end part 1204 of the blade 120.

During the high speed rotation of the blade 120, noise can be lowered through the enclosed hollow area 1206, to lower the noise generated during the high speed rotation of the fan blade 100, and then the noise lowering design of the fan blade 100 is achieved, and users' use experience is improved.

In some embodiments, producing the circular blade 120 through a casting molding process can improve production efficiency and lower production cost, however, while the end part 1204 of the circular blade 120 has high structure complexity, and the end part 1204 of the circular blade 120 needs to be molded through multiple molds of different demolding directions during production, and this renders the increase of the complexity and the cost of the molds, and complex end parts 1204 cannot be molded through molds in extreme situations. Meanwhile, during molding the end part 1204 of the blade 120 jointly through multiple molds, there is an inevitable gap between two adjacent molds, and this gap will form a burr on the end part 1204 of the blade 120, the burr will destruct the aerodynamic property of the blade 120, and then damage the aerodynamic performance of the blade 120 and increase an aerodynamic noise.

Therefore, on the blade 120 provided in the present disclosure, at least a portion of the area from the end part 1204 of the blade 120 to the root part 1202 of the blade 120 is the first segment part 122, that is, the first segment part 122 certainly cover the end part 1204 of the blade 120, and the first segment part 122 can be the tip end of the blade 120, the latter half segment of the blade 120, or the whole segment of the blade 120.

And the first segment part 122 comprises the first inner annular surface 1222 and the first outer annular surface 1224, when the fan blade 100 is observed in the axial direction of the hub 110, the first inner annular surface 1222 and the first outer annular surface 1224 turn directions at the end part 1204 through torsion, that is, the end part 1204 is a boundary area in the first segment part 122. For example, the first inner annular surface 1222 that can be observed originally turns to a back orientation through the torsion of the end part 1204, and the first outer annular surface 1224 that cannot be observed originally turns to a front orientation that can be observed through the torsion of the end part 1204, or, the first outer annular surface 1224 that can be observed originally turns to a back orientation through the torsion of the end part 1204, and the first inner annular surface 1222 that cannot be observed originally turns to a front orientation that can be observed through the torsion of the end part 1204.

Based on the above, the first outer annular surface 1224 and the first inner annular surface 1222 at the two sides of the end part 1204 do not overlap, for example, the first segment part 122 exposes the first outer annular surface 1224 before turning direction, and the first inner annular surface 1222 will not shield the first outer annular surface 1224 after the turning, and likewise, the first outer annular surface 1224 before the turning will not shield the first inner annular surface 1222 after the turning, vice versa.

Through arranging the first segment part 122 that does not overlap, the first segment part 122 can be molded by two molds, the demolding directions of the two molds correspond to the two directions of the axis of the hub 110, i.e., one mold demolds from the front face to mold the first inner annular surface 1222 and the first outer annular surface 1224 which can be observed from the front face; the other mold demolds from the back face to mold the first inner annular surface 1222 and the first outer annular surface 1224 which cannot be observed, to reduce the number of the molds for molding the first segment part 122; the end part 1204 corresponds to the parting line between two molds, i.e., the structure of the first side of the end part 1204 is molded through one of the molds, and the structure of the other side is molded through the other mold.

Thus it can be seen that the blade 120 provided in the present disclosure can reduce the number of the molds through optimizing the structure of the tip end, and reduce the complexity of the molds and the cost of the molds, and the blade 120 is applicable to an integrated molding process using molds, and meanwhile, reducing the number of the molds can reduce the probability of the burr occurring on the blade 120, and thus improve the aerodynamic performance of the blade 120, and reduce the aerodynamic noise of the blade 120, to solve the technical defects existing in the related art.

Furthermore, the technical effects of optimizing the structure of the blade 120, lowering the process complexity of the blade 120, lowering the product cost of the blade 120 and improving product performance of the blade 120 are achieved.

In some embodiments, the front face of the fan blade 100 corresponds to the front face of the hub 110, the back face of the fan blade 100 corresponds to the back face of the hub 110, the back face of the hub 110 comprises a blind hole for the inserted connection to a rotating shaft, and the rotating shaft is inserted into the fan blade 100 through the back face of the fan blade 100.

As shown in FIG. 2 and FIG. 7, in some embodiments of the present disclosure, in the radial direction of the hub 110, the distance between the end part 1204 and the axis of the hub 110 is the outer diameter d0 of the fan blade 100; in the radial direction of the hub 110, the length of the first segment part 122 is d1; d0 and d1 satisfy the following relation:

$$0.01 \times d0 \leqslant d1 \leqslant 0.2 \times d0.$$

In some embodiments, the area of the first segment part 122 is defined. In the radial direction of the hub 110, the distance between the end part 1204 and the axis of the hub 110 is the outer diameter d0 of the fan blade 100, and the outer diameter d0 is the sum of the radius of the hub 110 and the length of the blade 120.

Correspondingly, in the radial direction of the hub 110, the length of the first segment part 122 is d1, that is, a distance that the end part 1204 extends towards the root part 1202, the larger d1 is, the higher the coverage proportion of the first segment part 122 is; the smaller d1 is, the lower the coverage proportion of the first segment part 122 is.

On this basis, d0 and d1 satisfy the relation: $0.01\times d0 \leq d1 \leq 0.2\times d0$.

Through defining the above size relation, firstly, it can be ensured that the length of the first segment part 122 can meet the need of lowering the noise of the blade 120, and the noise lowering performance of the blade 120 is ensured, and secondly, it can be prevented that an excessively long first segment part 122 affects other intrinsic properties of the blade 120, then the applicable range of the blade 120 is widened, and the blade 120 can consider a plurality of aerodynamic advantages.

Meanwhile, through defining $d1 \leq 0.2\times d0$, it can provide convenience for the miniaturized design and the lightweight design of the fan blade 100.

As shown in FIG. 2 and FIG. 7, in some embodiments of the present disclosure, the blade 120 further comprises a second segment part 124, and the second segment part 124 comprises a second inner annular surface 1242 and a second outer annular surface 1244; the blade 120 further comprises a third segment part 126, and the third segment part 126 comprises a third inner annular surface 1262 and a third outer annular surface 1264; the first segment part 122 is connected to the second segment part 124 and the third segment part 126; in the axial direction of the hub 110, the second inner annular surface 1242 and the first inner annular surface 1222 are not shielded and the third outer annular surface 1264 and the first outer annular surface 1224 are not shielded, or, the third inner annular surface 1262 and the first inner annular surface 1222 are not shielded and the second outer annular surface 1244 and the first outer annular surface 1224 are not shielded.

In some embodiments, the blade 120 further comprises the second segment part 124 and the third segment part 126, the second segment part 124 and the third segment part 126 are respectively connected to the two sides of the first segment part 122, that is, the first segment part 122 is in a transitional connection to the second segment part 124 and the third segment part 126, and meanwhile, the second segment part 124 and the third segment part 126 are symmetric about the parting line on the first segment part 122.

On this basis, the second segment part 124 comprises the second inner annular surface 1242 and the second outer annular surface 1244, and the third segment part 126 comprises the third inner annular surface 1262 and the third outer annular surface 1264. When the fan blade 100 is observed through the axial direction of the hub 110, the face on the first segment part 122 connected to the second segment part 124 is the first outer annular surface 1224, then the second outer annular surface 1244 on the second segment part 124 and the first outer annular surface 1224 are simultaneously exposed, the second outer annular surface 1244 is not shielded, and correspondingly, the third inner annular surface 1262 on the third segment part 126 and the first inner annular surface 1222 at the other side of the end part 1204 are simultaneously exposed, and the third inner annular surface 1262 is not shielded, vice versa.

Through defining the above second segment part 124 and the third segment part 126, two air guiding segments can be formed on the basis of the first segment part 122, the two air guiding segments are used for guiding the flow direction of an airflow, firstly, this ensures that an air supply direction and an air supply strength meet needs, and secondly, this can cooperate with the first segment part 122 to lower the aerodynamic noise of the fan blade 100. Meanwhile, through defining the above simultaneous exposure relation, two molds can be used to mold the first segment part 122, the second segment part 124 and the third segment part 126 at the same time, to lower the process complexity of the fan blade 100, reduce the cost of the molds, and then improve the market competitiveness of the fan blade 100.

As shown in FIG. 2 and FIG. 7, in some embodiments of the present disclosure, in the radial direction of the hub 110, the distance between the end part 1204 and the axis of the hub 110 is the outer diameter d0 of the fan blade 100; in the radial direction of the hub 110, the length of the second segment part 124 is d2; d0 and d2 satisfy the following relation:

$$0 < d2 < 0.1 \times d0.$$

In some embodiments, the area of the second segment part 124 is defined. In the radial direction of the hub 110, the distance between the end part 1204 and the axis of the hub 110 is the outer diameter d0 of the fan blade 100, and the outer diameter d0 is the sum of the radius of the hub 110 and the length of the blade 120.

Correspondingly, in the radial direction of the hub 110, the length of the second segment part 124 is d2, that is, a distance that the end part 1204 extends towards the root part 1202, the larger d2 is, the higher the coverage proportion of the second segment part 124 is; the smaller d2 is, the lower the coverage proportion of the second segment part 124 is.

On this basis, d0 and d2 satisfy the relation: $0<d2<0.1\times d0$.

Through defining the above size relation, on the basis of meeting an airflow guiding need through the second segment part 124 and the third segment part 126, it can prevent affecting other intrinsic properties of the blade 120 due to an excessively long second segment part 124, then the applicable range of the blade 120 is widened, and the blade 120 can consider a plurality of aerodynamic advantages.

Meanwhile, through defining $d2<0.1\times d0$, it can provide convenience for the miniaturized design and the lightweight design of the fan blade 100.

As shown in FIG. 2 and FIG. 7, in some embodiments of the present disclosure, the fan blade 100 is configured to rotate in a first rotating direction; in the first rotating direction, the third outer annular surface 1264 is located at the front side of the second inner annular surface 1242.

In some embodiments, the calibrated rotating direction of the fan blade 100 is the first rotating direction, and the rotating direction during actual use may be the same with the calibrated rotating direction and may also be opposite to the calibrated rotating direction.

On this basis, in the first rotating direction, the third outer annular surface 1264 is located at the front side of the second inner annular surface 1242, correspondingly, the third inner annular surface 1262 is located at the front side of the second outer annular surface 1244, when the fan blade 100 rotates in the first rotating direction, the third outer annular surface 1264 and the second inner annular surface 1242 are windward sides, and the second outer annular surface 1244 and the third inner annular surface 1262 are leeward sides. Moreover, in the axial direction of the hub 110, the second segment part 124 and the third segment part 126 are in a staggered arrangement, the third segment part 126 is close to the front face of the hub 110, and the second segment part 124 is close to the back face of the hub 110.

Through defining the above relation between the position of the second segment part 124 and the calibrated rotating direction and the relation between the position of the third segment part 126 and the calibrated rotating direction, the noise lowering performance of the blade 120 can be optimized, the noise lowering effect of the blade 120 during high speed rotation can be optimized, and thus users' use experience is improved.

Figure 4:
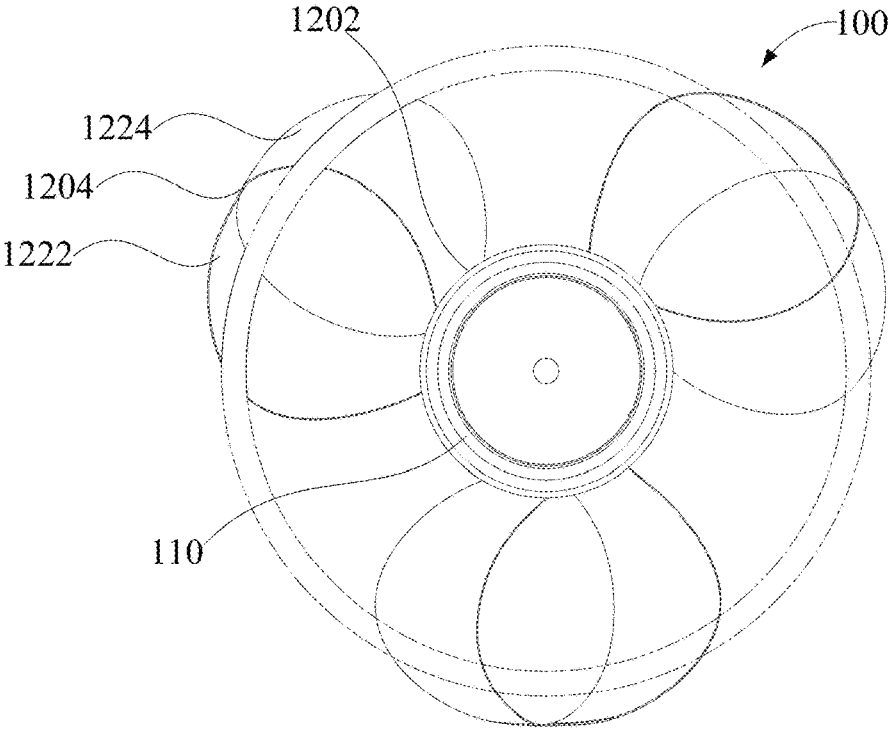
FIG. 4 is a front view of a fan blade according to an embodiment of the present disclosure.
Figure 5:
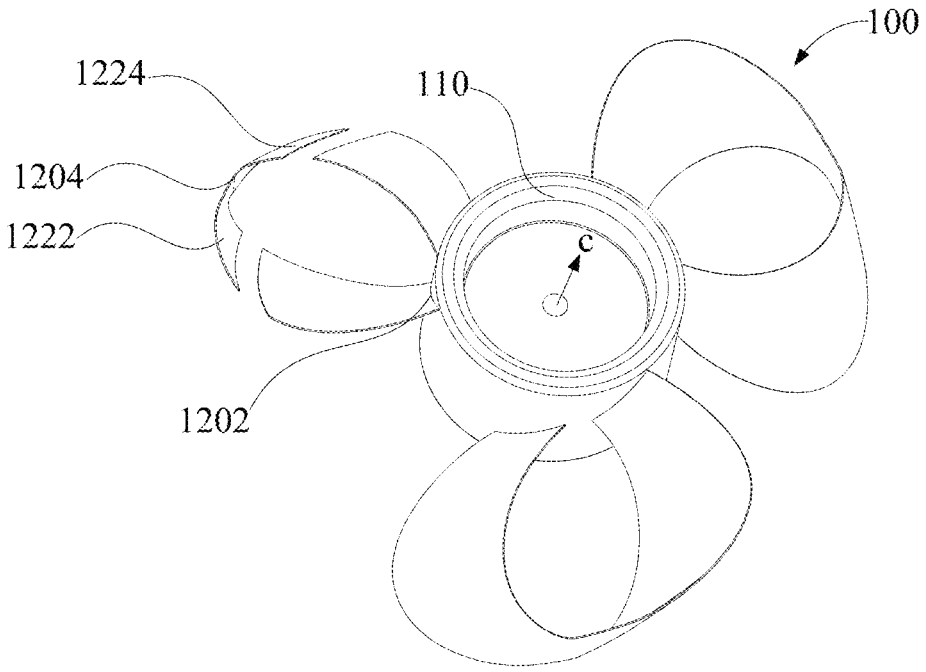
FIG. 5 is a schematic view of the structure of a fan blade according to an embodiment of the present disclosure.
Figure 6:
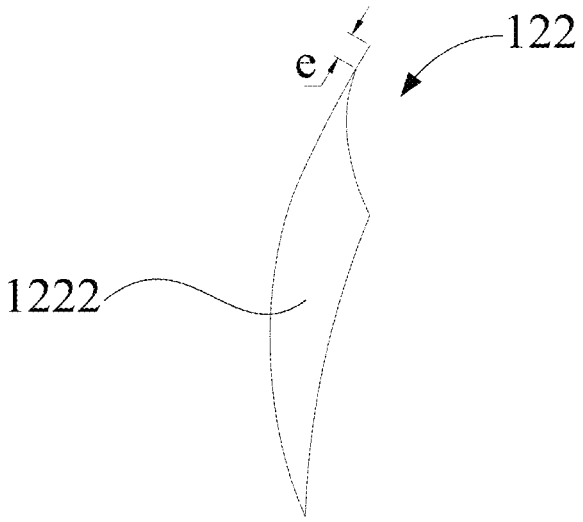
FIG. 6 is a schematic view of the structure of a first segment part according to an embodiment of the present disclosure.

As shown in FIG. 4, FIG. 5 and FIG. 6, in some embodiments of the present disclosure, at least a portion of the first inner annular surface 1222 close to the end part 1204 extends in the axial direction of the hub 110; and/or at least a portion of the first outer annular surface 1224 close to the end part 1204 extends in the axial direction of the hub 110.

FIG. 4 is a front view of a fan blade 100 according to an embodiment of the present disclosure.

FIG. 5 is a schematic view of the structure of a fan blade 100 according to an embodiment of the present disclosure, and the arrow c in FIG. 5 shows the axial direction of the hub 110.

FIG. 6 is a schematic view of the structure of a first segment part 122 according to an embodiment of the present disclosure, and the line shown by the arrow e in FIG. 6 indicates the overlapping area of the first inner annular surface 1222.

In some embodiments, at least a portion of the first inner annular surface 1222 close to the end part 1204 can extend in the axial direction of the hub 110, when the fan blade 100 is observed from the axial direction of the hub 110, the points in at least a portion of the first inner annular surface 1222 overlap to form a line, that is, at least a portion of the area of the first inner annular surface 1222 is shielded by itself.

Correspondingly, at least a portion of the first outer annular surface 1224 close to the end part 1204 can also extend in the axial direction of the hub 110, when the fan blade 100 is observed from the axial direction of the hub 110, the points in at least a portion of the first outer annular surface 1224 overlap to form a line, that is, at least a portion of the area of the first outer annular surface 1224 is shielded by itself.

Through defining the above features, the sharpness and the torsion amplitude of the end part 1204 of the blade 120 can be reduced on the basis that the number of molds and the structure complexity of the molds are not increased, and then the aerodynamic performance of the blade 120 is optimized, and the blade 120 can meet the air supply need and the noise lowering need of the fan blade 100.

Figure 13:
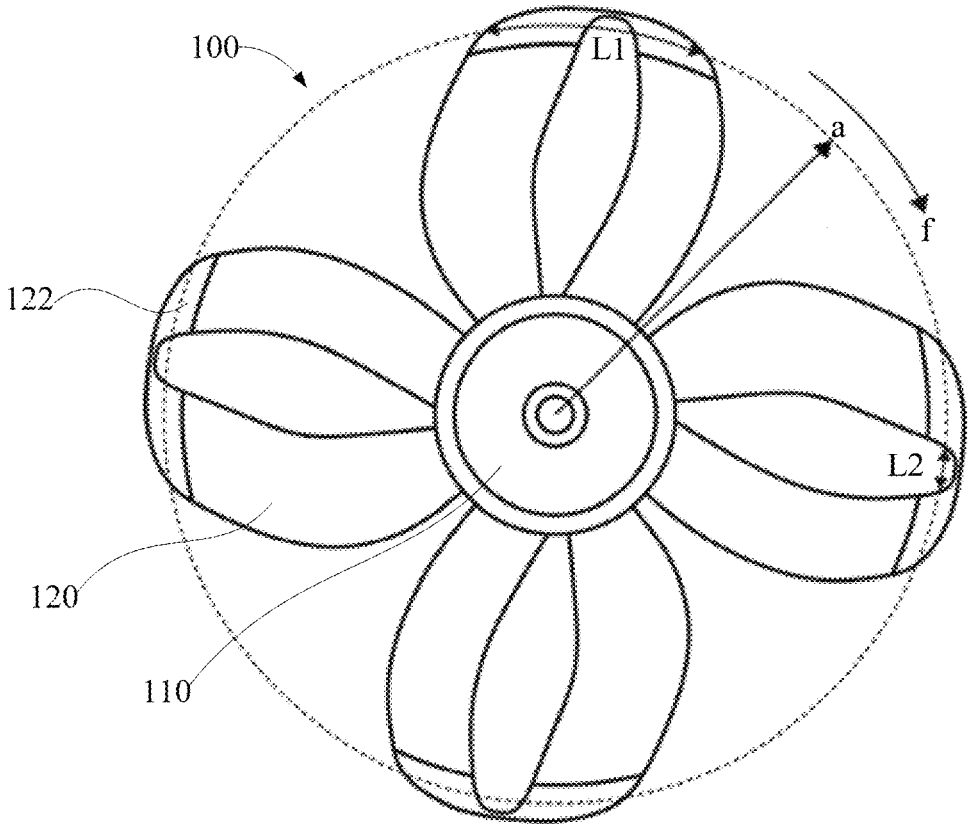
FIG. 13 is a front view of a fan blade according to an embodiment of the present disclosure.

As shown in FIG. 13, in some embodiments of the present disclosure, in the circumferential direction of the hub 110, the size of the hollow area 1206 is L2; and L2>5 mm.

FIG. 13 is a front view of a fan blade 100 according to an embodiment of the present disclosure, and the arrow a shows the radial direction of the hub 110, the arrow f shows the circumferential direction of the hub 110.

In some embodiments, in the circumferential direction of the hub 110, the size of the hollow area 1206 enclosed by the inner annular surface 1208 of the blade 120 is L2, when the fan blade 100 is observed from the axial direction of the hub 110, L2 is the length of an arc segment in the hollow area 1206 which axis is the axis of the hub 110, and the size of L2 affects the width of the hollow area 1206.

On this basis, L2 needs to be greater than 5 mm; through defining the above size range, it can be ensured that there is a sufficiently wide hollow area 1206 at the inner side of the blade 120, to ensure the noise lowering performance during the high speed rotation of the blade 120, and then the technical effects of lowering the aerodynamic noise of the fan blade 100 and improving users' use experience are achieved.

As shown in FIG. 13, in some embodiments of the present disclosure, in the circumferential direction of the hub 110, the size of the first segment part 122 is L1; L1 decreases gradually in the direction from the root part 1202 to the end part 1204.

In some embodiments, in the circumferential direction of the hub 110, the size of the first segment part 122 is L1, when the fan blade 100 is observed from the axial direction of the hub 110, L1 is the length of an arc segment connecting the outer contour lines on both sides of the first segment part 122, and the arc segment takes the axis of the hub 110 as its axis, and the size of L1 affects the width of the first segment part 122.

On this basis, in the direction from the root part 1202 of the blade 120 to the end part 1204 of the blade 120, L1 decreases gradually, that is, the width of the first segment part 122 tapers in the direction away from the hub 110, and the first segment part 122 present a sharp shape. Through defining the shape of the above first segment part 122, the noise lowering performance can be ensured during the high speed rotation of the blade 120, and then the technical effects of lowering the aerodynamic noise of the fan blade 100 and improving users' use experience are achieved.

Figure 14:
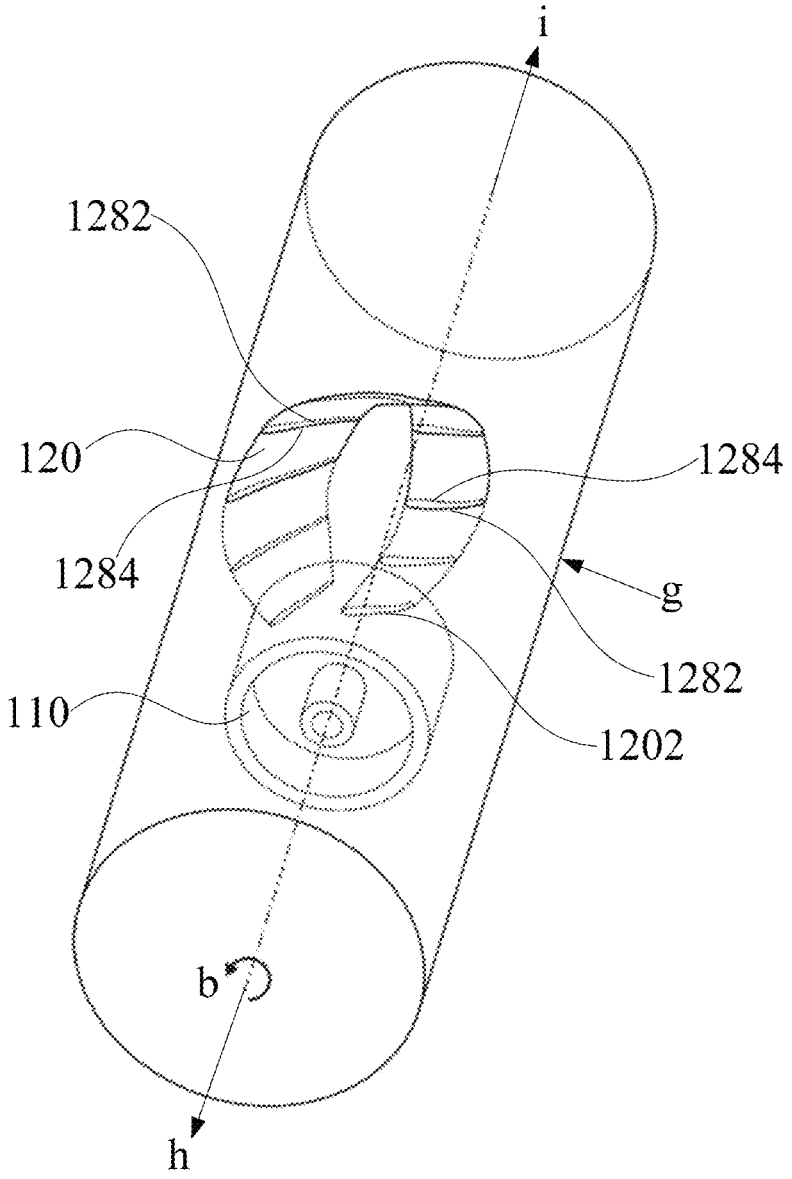
FIG. 14 is a schematic view of the structure of a fan blade according to an embodiment of the present disclosure.
Figure 15:
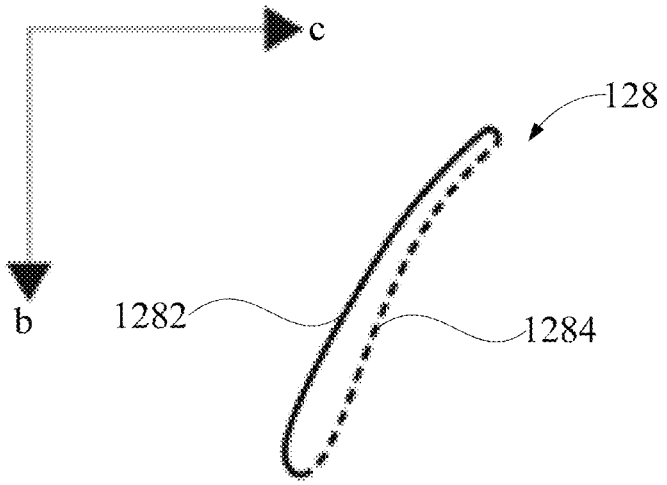
FIG. 15 is a schematic view of the cross-section of a fan blade according to an embodiment of the present disclosure.

As shown in FIG. 14 and FIG. 15, in some embodiments of the present disclosure, the blade 120 is sectioned through a curved plane taking the axis of the hub 110 as its axis, and then the cross-section 128 of the blade 120 is obtained; the outer contour of the cross-section 128 comprises a first smooth curve 1282 protruding outwards and a second smooth curve 1284 concaved inwards.

FIG. 14 is a schematic view of the structure of a fan blade 100 according to an embodiment of the present disclosure. The arrow b in FIG. 14 shows the first rotating direction of the fan blade 100, the arrow g shows the curved plane which takes the axis of the hub 110 as its axis, the arrow h shows a first axial direction of the hub 110, and arrow i shows a second axial direction of the hub 110. The first axial direction and the second axial direction are opposite.

FIG. 15 is a schematic view of the cross-section 128 of a fan blade 100 according to an embodiment of the present disclosure, and after the sectioning, the cross-section 128 is unfolded and then is a plane, the arrow b shows the first rotating direction of the fan blade 100, and the arrow c shows the axial direction of the hub 110.

In some embodiments, the shape of the blade 120 is defined. Any area of the blade 120 is sectioned through the curved plane taking the axis of the hub 110 as its axis, to obtain the cross-section 128 of the blade 120. The outer contour of the cross section 128 of the blade 120 includes a first smooth curve 1282 that is convex relative to the first axial direction, or convex relative to the second axial direction. When the first smooth curve 1282 is convex relative to the first axial direction, the outer contour of the first cross section 128 of the blade 120 also includes a second smooth curve 1284 that is concave relative to the first axial direction. Similarly, when the first smooth curve 1282 is convex relative to the second axial direction, the outer contour of the cross section 128 of the blade 120 also includes a second smooth curve 1284 that is concave relative to the second axial direction. The first smooth curve 1282 and the second smooth curve 1284 are snapped to form the outer contour of the cross-section 128 of the blade 120.

As shown in FIG. 9, FIG. 10, FIG. 11 and FIG. 12, through defining the shape of the above cross-section 128, the blade 120 keeps a torsion trend throughout the whole segment; it is taken as an example that the two ends of the blade 120 are both connected to the circumferential side face of the hub 110, and the first end of the blade 120 first exposes the outer annular surface 1209, in the direction from the first end of the blade 120 to the end part 1204, the blade 120 changes the exposed area of the outer annular surface 1209 through torsion, until the torsion continues to the end part 1204 and then the turning of the inner and outer annular surfaces 1209 is completed, then the inner annular surface 1208 starts to be exposed; in the direction from the end part 1204 to the second end of the blade 120, the exposed area of the inner annular surface 1208 also changes in with the torsion trend, vice versa, that is, a strip-shaped blade 120 maintains torsion during surrounding.

Figure 9:
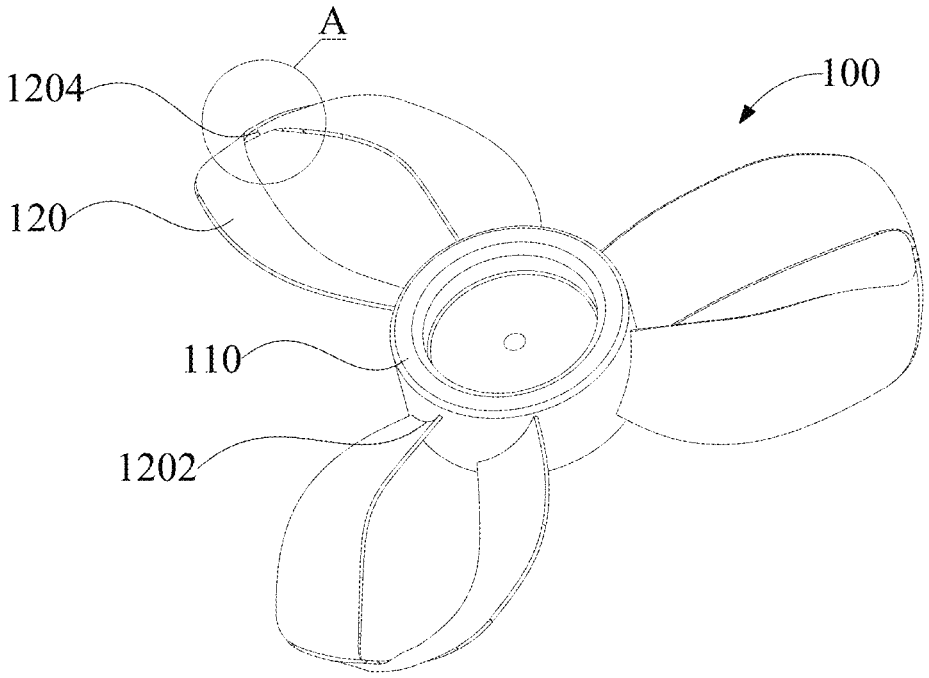
FIG. 9 is a schematic view of the structure of a fan blade according to an embodiment of the present disclosure.

FIG. 9 is a schematic view of the structure of a fan blade 100 according to an embodiment of the present disclosure.

Figure 10:
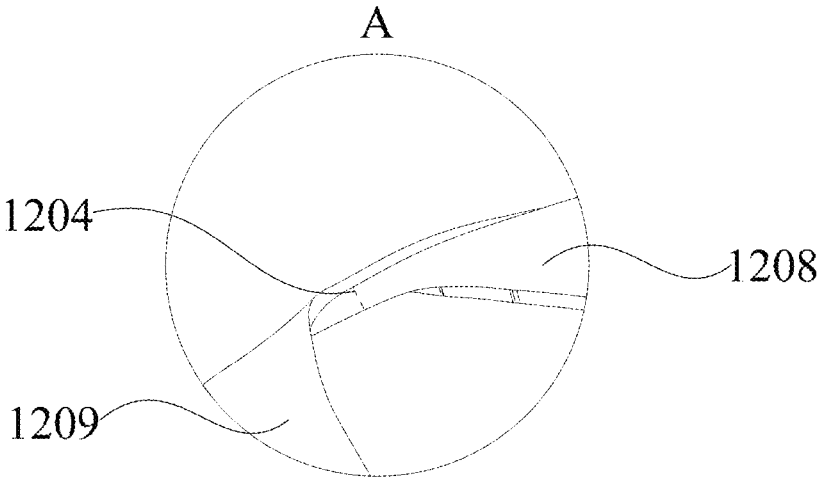
FIG. 10 is a partial enlarged view of the area A of the fan blade in some embodiments shown in FIG. 9.

FIG. 10 is a partial enlarged view of the area A of the fan blade 100 in some embodiments shown in FIG. 9.

Figure 11:
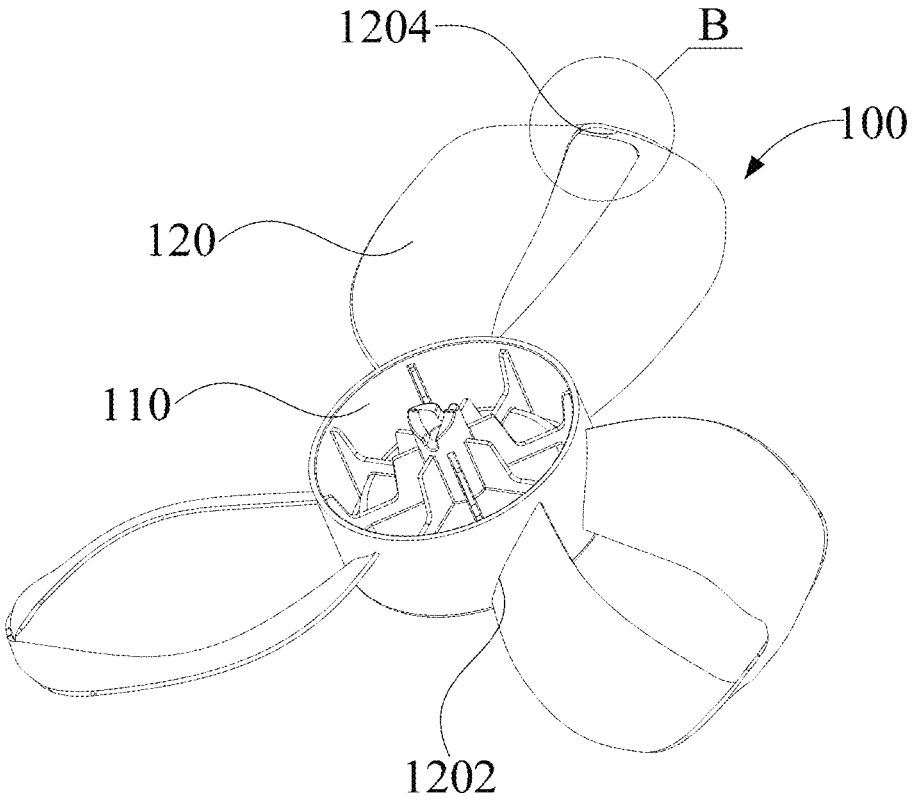
FIG. 11 is a schematic view of the structure of a fan blade according to an embodiment of the present disclosure.

FIG. 11 is a schematic view of the structure of a fan blade 100 according to an embodiment of the present disclosure.

Figure 12:
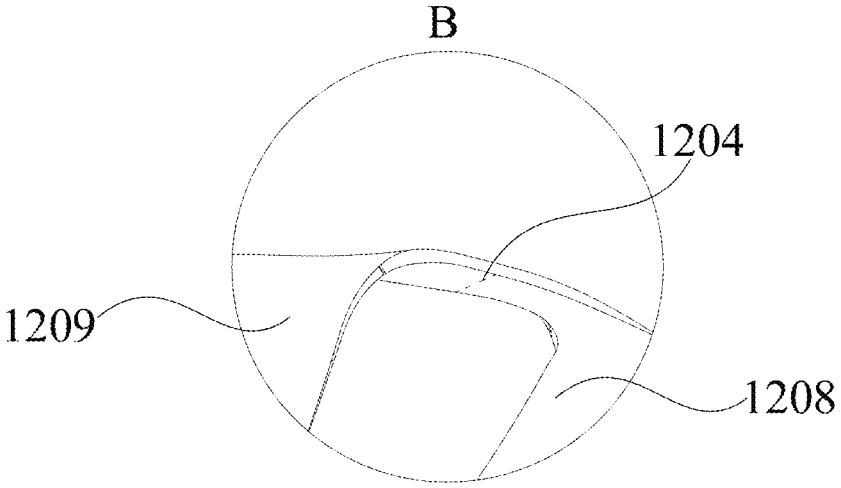
FIG. 12 is partial enlarged view of the area B of the fan blade in some embodiments shown in FIG. 11.

FIG. 12 is partial enlarged view of the area B of the fan blade 100 in some embodiments shown in FIG. 11.

Through defining the shape of the cross-section 128 of the above blade 120, the point of sudden change of shape on the blade 120 can be prevented, therefore, firstly, the noise lowering performance during the high speed rotation of the blade 120 is ensured, then the technical effects of lowering the aerodynamic noise of the fan blade 100 and improving users' use experience are achieved, and secondly, the resistance of the blade 120 is lowered, and the energy efficiency ratio of an air supply device 200 is improved.

As shown in FIG. 14 and FIG. 15, in some embodiments of the present disclosure, the fan blade 100 is configured to rotate in the first rotating direction; in the first rotating direction, the second smooth curve 1284 is located at the front side of the first smooth curve 1282.

In some embodiments, the calibrated rotating direction of the fan blade 100 is the first rotating direction, and the rotating direction during actual use may be the same with the calibrated rotating direction and may also be opposite to the calibrated rotating direction.

On this basis, in the first rotating direction, the second smooth curve 1284 is located at the front side of the first smooth curve 1282, in the process that the fan blade 100 rotates in the first rotating direction as calibrated, the first smooth curve 1282 corresponds to a pressure side of the blade 120, and the second smooth curve 1284 corresponds to a sucking side of the blade 120.

Through defining the relation between the shape of the blade 120 and the rotating direction, the noise lowering performance of the blade 120 can be optimized, the noise lowering effect during the high speed rotation of the blade 120 be optimized, and thus users' use experience is improved.

As shown in FIG. 2 and FIG. 7, in some embodiments of the present disclosure, the number of blades 120 is plural; and the plurality of blades 120 are uniformly distributed around the hub 110.

In some embodiments, the number of blades 120 is plural, and the plurality of blades 120 are uniformly distributed around the axis of the hub 110, that is, the included angle between any two adjacent blades 120 among the plurality of blades 120 is the same.

In some embodiments, the number of the blades 120 is greater than or equal to 3.

Through arranging the plurality of uniformly distributed blades 120, the air supply strength and the air supply uniformity of the fan blade 100 can be improved without changing the rotation speed of the fan blade 100, thus the aerodynamic performance of the fan blade 100 is optimized, and the practicability and reliability of the fan blade 100 is improved.

Figure 16:
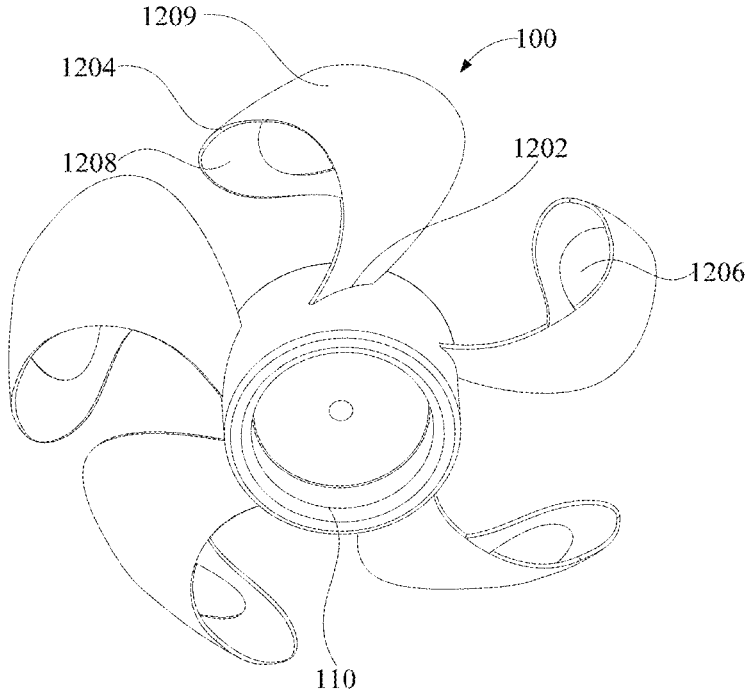
FIG. 16 is a schematic view of the structure of a fan blade according to an embodiment of the present disclosure.
Figure 17:
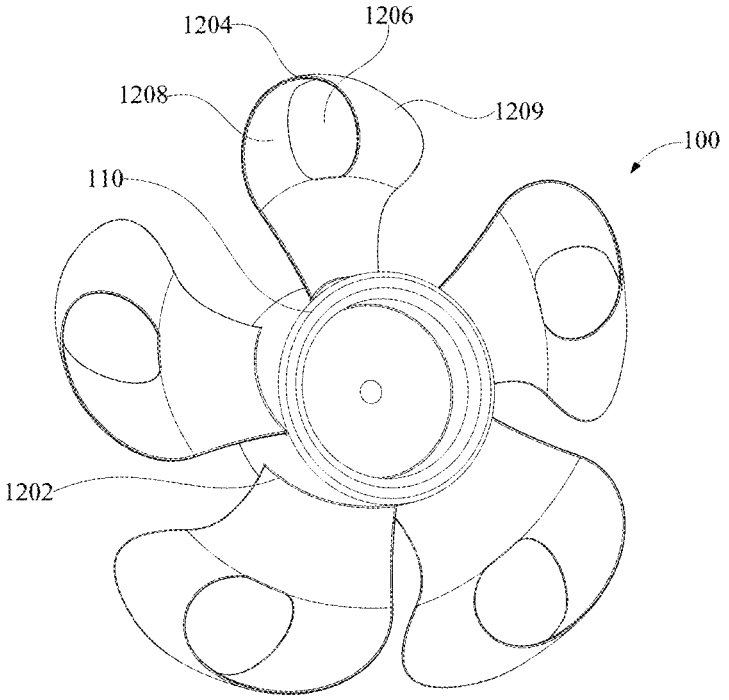
FIG. 17 is a schematic view of the structure of a fan blade according to an embodiment of the present disclosure.

As shown in FIG. 16 and FIG. 17, in an embodiment of the present disclosure, the first half segment of the blade 120 is a monolithic structure, the latter half segment of the blade 120 is a circular structure, and the blade 120 encloses the hollow area 1206 through the inner annular surface 1208.

FIG. 16 is a schematic view of the structure of a fan blade 100 according to an embodiment of the present disclosure.

FIG. 17 is a schematic view of the structure of a fan blade 100 according to an embodiment of the present disclosure.

Figure 18:
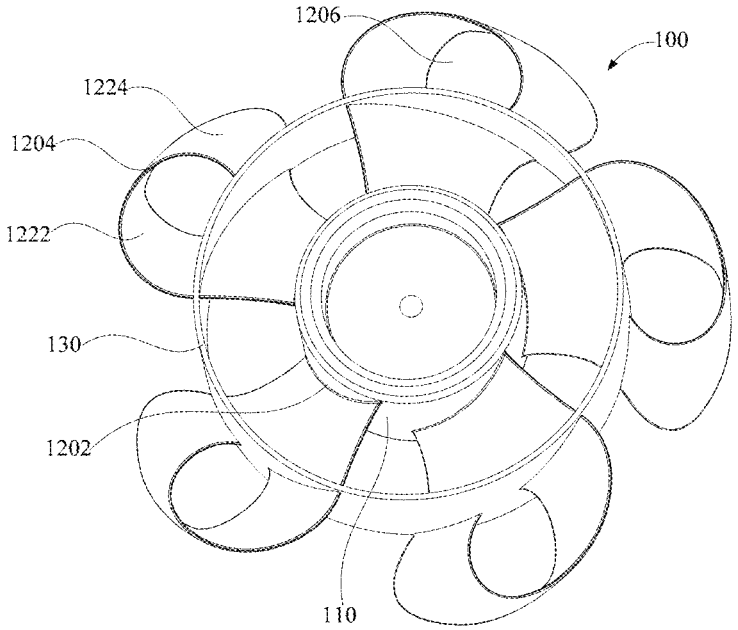
FIG. 18 is a schematic view of the structure of a fan blade according to an embodiment of the present disclosure.

As shown in FIG. 18, in an embodiment of the present disclosure, the fan blade 100 further comprises an air guiding ring 130, the air guiding ring 130 cuts off the blade 120, the blade 120 at the outer side of the air guiding ring 130 presents a circular shape, the blade 120 at the inner side of the air guiding ring 130 presents a monolithic shape, and thus the aerodynamic performance of the fan blade 100 is optimized.

FIG. 18 is a schematic view of the structure of a fan blade 100 according to an embodiment of the present disclosure.

Figure 19:
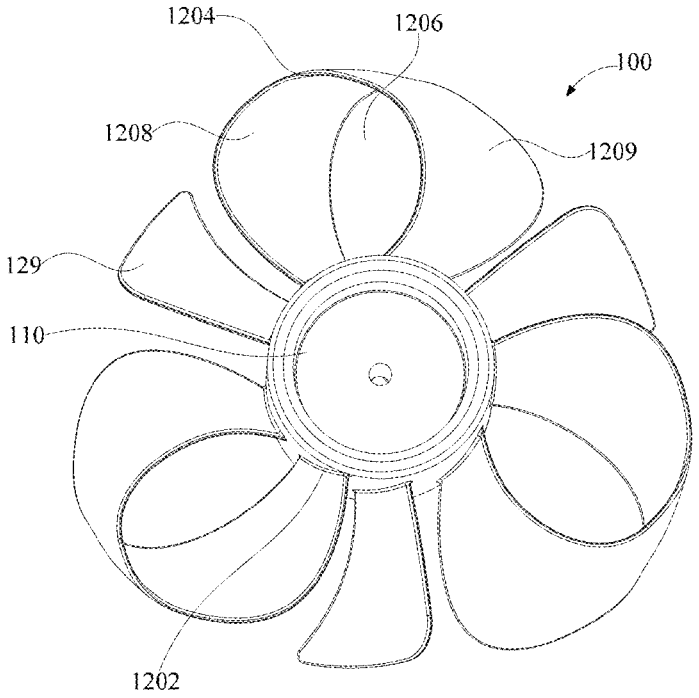
FIG. 19 is a schematic view of the structure of a fan blade according to an embodiment of the present disclosure.

As shown in FIG. 19, in an embodiment of the present disclosure, the fan blade 100 further comprises a second blade 129, the second blade 129 is a monolithic structure, a plurality of second blades 129 and a plurality of circular blades 120 are arranged alternately, and thus the aerodynamic performance of the blade 100 is optimized.

FIG. 19 is a schematic view of the structure of a fan blade 100 according to an embodiment of the present disclosure.

Figure 20:
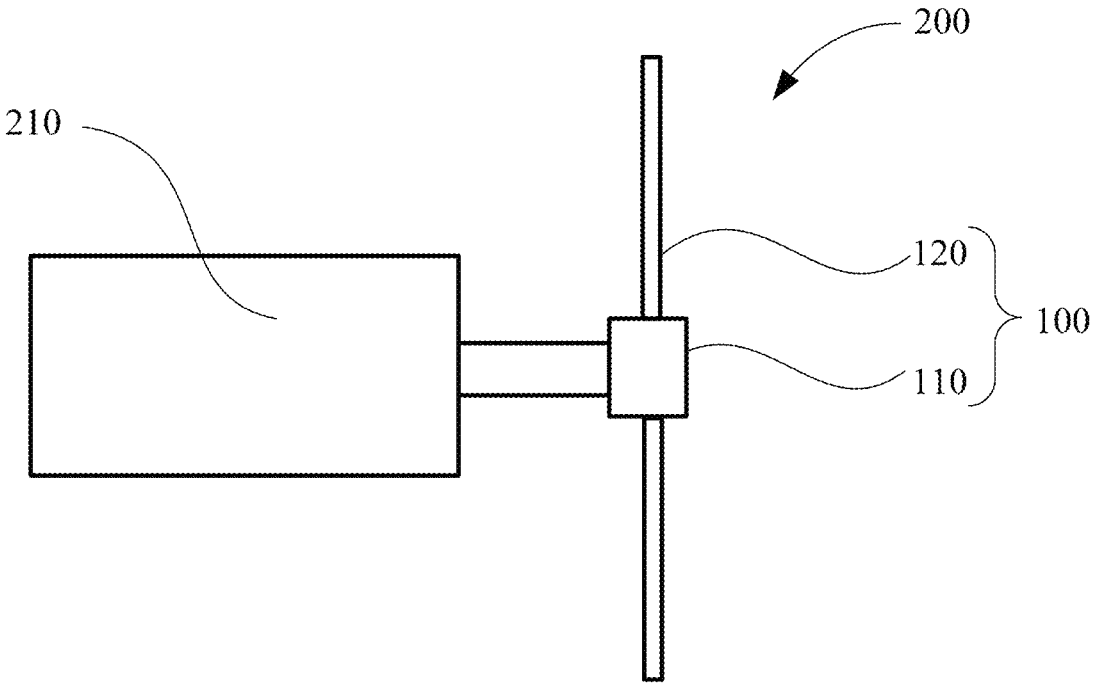
FIG. 20 is a schematic view of the structure of an air supply device according to an embodiment of the present disclosure.

As shown in FIG. 20, the second aspect of the present disclosure provides an air supply device 200, and the air supply device 200 comprises: the fan blade 100 in any of the above embodiments; a driving part 210 connected to the hub 110, and the driving part 210 is used for driving the fan blade 100 to rotate.

FIG. 20 is a schematic view of the structure of an air supply device 200 according to an embodiment of the present disclosure.

In some embodiments, the air supply device 200 comprising the fan blade 100 in any of the above embodiments is defined, and the air supply device 200 comprises a pedestal fan, a cooling fan, an exhaust fan, etc. Therefore, the air supply device 200 comprises the advantages of the fan blade 100 in any of the above embodiments, and can achieve the technical effects that the fan blade 100 in any of the above embodiments can achieve, which are not repeated herein to avoid repetition.

On this basis, the air supply device 200 further comprises the driving part 210, the driving part 210 is connected to the hub 110 on the fan blade 100, and after electrified, the driving part 210 is used to bring the hub 110 and the blades 120 to rotate synchronously.

In some embodiments, the driving part 210 comprises a motor, and a rotating shaft of the motor is inserted into the hub 110 to bring the hub 110 and the blades 120 to rotate.

It needs to be noted that in the claims, the description and the accompanying drawings of the description of the present disclosure, the phrase of "a plurality of" indicates two or more than two, unless otherwise explicitly specified or defined. The orientation or position relations indicated by the terms of "upper", "lower" and the like are based on the orientation or position relations shown in the accompanying drawings, and they are just intended to conveniently describe the present disclosure and simplify the description, and are not intended to indicate or imply that the devices or units as indicated should have specific orientations or should be configured or operated in specific orientations, and then should not be construed as limitations to the present disclosure. The terms of "connected", "mounting", "fixing" and the like should be understood in a broad sense, for example, "connected" may be a fixed connection between a plurality of objects, and may also be a removable connection therebetween, or an integral connection; and may also be a direct connection between a plurality of objects and may also be an indirect connection between a plurality of objects through an intermediate medium. A person of ordinary skills in the art could understand the specific meanings of the terms in the present disclosure according to specific situations.

In the claims, the description and the accompanying drawings of the description of the present disclosure, the descriptions of the phrases "one embodiment", "some embodiments" and "specific embodiment" and the like mean that the specific features, structures, materials or characteristics described in combination with the embodiment(s) or example(s) are included in at least one embodiment or example of the present disclosure. In the description and the accompanying drawings of the description of the present disclosure, the schematic representation of the above phrases does not necessarily refer to the same embodiment or example. Moreover, the particular features, structures, materials or characteristics described may be combined in a suitable manner in any one or more of the embodiments or examples.

The descriptions above are only some embodiments of the present disclosure, and are not used to limit the present disclosure. For a person skilled in the art, the present disclosure may have various changes and variations. Any modifications, equivalent substitutions, improvements, etc. made within the spirit and principle of the present disclosure shall all be included in the protection scope of the present disclosure.

What is claimed is:

1. A fan blade, comprising:

a hub;

a blade connected to a circumferential side face of the hub, wherein the blade presents a circular shape, an inner annular surface of the blade encloses a hollow area, or the inner annular surface of the blade and the circumferential side face of the hub enclose a hollow area;

wherein, in a radial direction of the hub, an end of the blade connected to the hub is a root part of the blade, and an end thereof away from the hub is an end part of the blade;

in a direction from the end part to the root part, at least a portion of an area of the blade is a first segment part, and the first segment part comprises a first inner annular surface and a first outer annular surface;

in an axial direction of the hub, the first inner annular surface and the first outer annular surface turn direction at the end part through torsion so that the first inner annular surface is connected to the first outer annular surface, and the first inner annular surface and the first outer annular surface on both sides of the end part do not overlap.

2. The fan blade according to claim 1, wherein:

in the radial direction of the hub, a distance between the end part and an axis of the hub is an outer diameter d0 of the fan blade;

in the radial direction of the hub, a length of the first segment part is d1;

wherein, d0 and d1 satisfy:

$$0.01 \times d0 \leq d1 \leq 0.2 \times d0.$$

3. The fan blade according to claim 1, wherein the blade comprises:

a second segment part comprising a second inner annular surface and a second outer annular surface; and a third segment part comprising a third inner annular surface and a third outer annular surface;

wherein, the first segment part is connected to the second segment part and the third segment part;

wherein, in the axial direction of the hub, the second inner annular surface and the first inner annular surface are not shielded, and the third outer annular surface and the first outer annular surface are not shielded, or, the third inner annular surface and the first inner annular surface are not shielded, and the second outer annular surface and the first outer annular surface are not shielded.

4. The fan blade according to claim 3, wherein:

in the radial direction of the hub, a distance between the end part and an axis of the hub is an outer diameter d0 of the fan blade;

in the radial direction of the hub, a length of the second segment part is d2;

wherein, d0 and d2 satisfy:

$$0 < d2 < 0.1 \times d0.$$

5. The fan blade according to claim 3, wherein:

the fan blade is configured to rotate in a first rotating direction;

in the first rotating direction, the third outer annular surface is located at a front side of the second inner annular surface.

6. The fan blade according to claim 1, wherein:

at least a portion of the first inner annular surface close to the end part extends in the axial direction of the hub; and/or at least a portion of the first outer annular surface close to the end part extends in the axial direction of the hub.

7. The fan blade according to claim 1, wherein:

in a circumferential direction of the hub, a size of the hollow area is L2; and L2 satisfies: L2>5 mm.

8. The fan blade according to claim 1, wherein:

in a circumferential direction of the hub, a size of the first segment part is L1; and L1 decreases gradually in a direction from the root part to the end part.

9. The fan blade according to claim 1, wherein:

a cross-section of the blade obtained by a curved plane centered about an axis of the hub transversely intersecting the blade has an outer contour which comprises a first smooth convex curve and a second smooth concave curve.

10. The fan blade according to claim 9, wherein:

the fan blade is configured to rotate in a rotating direction; and in a first rotating direction, the second smooth concave curve is located at a front side of the first smooth convex curve.

11. The fan blade according to claim 1, wherein:

a number of blades is plural; and the plurality of blades are uniformly distributed around the hub.

12. An air supply device, comprising:

a fan blade, comprising:

a hub;

a blade connected to a circumferential side face of the hub, wherein the blade presents a circular shape, an inner annular surface of the blade encloses a hollow area, or the inner annular surface of the blade and the circumferential side face of the hub enclose a hollow area;

wherein, in a radial direction of the hub, an end of the blade connected to the hub is a root part of the blade, and an end thereof away from the hub is an end part of the blade;

in a direction from the end part to the root part, at least a portion of an area of the blade is a first segment part, and the first segment part comprises a first inner annular surface and a first outer annular surface;

in an axial direction of the hub, the first inner annular surface and the first outer annular surface turn direction at the end part, through torsion so that the first inner annular surface is connected to the first outer annular surface, and the first inner annular surface and the first outer annular surface on both sides of the end part do not overlap, an outer contour of a cross-section of the blade comprises a first smooth convex curve and a second smooth concave curve, and the first smooth convex curve and the second smooth concave curve are snapped to form the outer contour of the cross-section of the blade; and a driving part connected to the hub, wherein the driving part is used for driving the fan blade to rotate.

13. The air supply device according to claim 12, wherein:

in the radial direction of the hub, a distance between the end part and an axis of the hub is an outer diameter d0 of the fan blade;

in the radial direction of the hub, a length of the first segment part is d1;

wherein, d0 and d1 satisfy:

$$0.01 \times d0 \leq d1 \leq 0.2 \times d0.$$

14. The air supply device according to claim 12, wherein the blade comprises:

a second segment part comprising a second inner annular surface and a second outer annular surface; and a third segment part comprising a third inner annular surface and a third outer annular surface;

wherein, the first segment part is connected to the second segment part and the third segment part;

wherein, in the axial direction of the hub, the second inner annular surface and the first inner annular surface are not shielded, and the third outer annular surface and the first outer annular surface are not shielded, or, the third inner annular surface and the first inner annular surface are not shielded, and the second outer annular surface and the first outer annular surface are not shielded.

15. The air supply device according to claim 14, wherein:

in the radial direction of the hub, a distance between the end part and an axis of the hub is an outer diameter d0 of the fan blade;

in the radial direction of the hub, a length of the second segment part is d2;

wherein, d0 and d2 satisfy:

$$0 < d2 < 0.1 \times d0.$$

16. The air supply device according to claim 14, wherein:

the fan blade is configured to rotate in a first rotating direction;

in the first rotating direction, the third outer annular surface is located at a front side of the second inner annular surface.

17. The air supply device according to claim 12, wherein:

at least a portion of the first inner annular surface close to the end part extends in the axial direction of the hub; and/or at least a portion of the first outer annular surface close to the end part extends in the axial direction of the hub.

18. The air supply device according to claim 12, wherein:

in a circumferential direction of the hub, a size of the hollow area is L2; and L2 satisfies: L2>5 mm.

19. The air supply device according to claim 12, wherein:

in a circumferential direction of the hub, a size of the first segment part is L1; and L1 decreases gradually in a direction from the root part to the end part.

20. The air supply device according to claim 12, wherein:

a cross-section of the blade obtained by a curved plane centered about an axis of the hub transversely intersecting the blade has an outer contour which comprises a first smooth convex curve and a second smooth concave curve.

* * * * *